US011046547B2

(12) United States Patent
Harpster et al.

(10) Patent No.: US 11,046,547 B2
(45) Date of Patent: Jun. 29, 2021

(54) BAIL CONTROL FOR SHEET MEDIA

(71) Applicant: Hewlett-Packard Development Company, L.P., Spring, TX (US)

(72) Inventors: Leonard Luke Harpster, Vancouver, WA (US); Daniel Fredrickson, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 127 days.

(21) Appl. No.: 16/337,071

(22) PCT Filed: Oct. 5, 2016

(86) PCT No.: PCT/US2016/055532
§ 371 (c)(1),
(2) Date: Mar. 27, 2019

(87) PCT Pub. No.: WO2018/067144
PCT Pub. Date: Apr. 12, 2018

(65) Prior Publication Data

US 2020/0031147 A1 Jan. 30, 2020

(51) Int. Cl.

| | |
|---|---|
| ***B65H 31/26*** | (2006.01) |
| ***B41J 13/10*** | (2006.01) |
| ***B41J 13/20*** | (2006.01) |
| *B65H 31/02* | (2006.01) |

(52) U.S. Cl.
CPC ..... *B65H 31/26* (2013.01); *B41J 13/103* (2013.01); *B41J 13/20* (2013.01); *B65H 31/02* (2013.01); *B65H 2220/02* (2013.01); *B65H 2515/32* (2013.01)

(58) Field of Classification Search
CPC ... B65H 3/54; B65H 7/00; B65H 7/20; B65H 31/00; B65H 31/02; B65H 31/26; B65H 2403/73; B65H 2403/733; B65H 43/00; B41J 13/20
USPC ..... 271/220
See application file for complete search history.

(56) References Cited

U.S. PATENT DOCUMENTS

| | | | | |
|---|---|---|---|---|
| 3,951,264 A * | 4/1976 | Heidecker | G11B 17/049 206/308.3 |
| 4,852,868 A | 8/1989 | Fukui et al. | |
| 5,078,379 A | 1/1992 | Leisner | |
| 5,260,759 A * | 11/1993 | Kobayashi | B65H 29/00 271/220 |
| 5,462,267 A * | 10/1995 | Hori | B65H 3/0669 271/10.04 |
| 5,915,690 A * | 6/1999 | Surya | B65H 1/04 271/265.01 |
| 6,126,164 A | 10/2000 | Rennick et al. | |
| 6,547,238 B2 | 4/2003 | Ardery et al. | |

(Continued)

FOREIGN PATENT DOCUMENTS

| | | |
|---|---|---|
| JP | S63144063 A | 6/1988 |
| JP | 04277159 | 10/1992 |

(Continued)

*Primary Examiner* — Prasad V Gokhale
(74) *Attorney, Agent, or Firm* — Steven Ormiston

(57) ABSTRACT

In one example, a bail system for a sheet media tray includes a bail to apply a force to a sheet in the tray, a bias mechanism to counter the force of the bail on the sheet, and a control mechanism to control the degree to which the bias mechanism counters the force of the bail on the sheet.

12 Claims, 8 Drawing Sheets

(56) References Cited

U.S. PATENT DOCUMENTS

| | | | | |
|---|---|---|---|---|
| 8,006,971 | B2 | 8/2011 | Iguchi et al. | |
| 9,206,010 | B2 | 12/2015 | Shelhart et al. | |
| 2007/0069454 | A1* | 3/2007 | Ino | B65H 43/06 271/220 |
| 2014/0061994 | A1 | 3/2014 | Mimura et al. | |
| 2015/0307311 | A1* | 10/2015 | Ono | G03G 21/1647 271/176 |
| 2019/0144221 | A1* | 5/2019 | Lo | B65H 1/18 271/30.1 |

FOREIGN PATENT DOCUMENTS

| | | |
|---|---|---|
| JP | H06-171775 | 6/1994 |
| JP | 2009067595 | 4/2009 |
| WO | WO-2004061787 A2 | 7/2004 |

* cited by examiner 10
12
13
14
18
19
20
22
24
26
28
32
34
38
40
42
43
44
46
50
52
54

BAIL CONTROL FOR SHEET MEDIA

BACKGROUND

The output devices used in or with some printers, copiers, and other sheet media processing machines include a bail to help control sheets discharged to a stack of sheets. The sheets slide under the bail as they are discharged on to the stack, for example to stop each sheet in the desired position in the output tray.

DRAWINGS

The same part numbers designate the same or similar parts throughout the figures. The figures are not necessarily to scale.

DESCRIPTION

Some sheet media processing machines are capable of processing multiple different sheet types and sizes. The speed, force, or other sheet discharge conditions may vary in a particular machine or between different machines that utilize the same type of output device. For example, the bail force desired to properly control a sheet of uncoated A3 size printer paper may be inadequate to properly control a shorter stiffer A4 sheet of paper or a slicker sheet of coated paper.

A new bail system has been developed to help expand the range of forces a bail can deliver to accommodate a greater variety of media sheets and discharge conditions. In one example, a bail system includes a bail to apply a force to the sheets, a spring or other bias mechanism to counter the force of the bail on the sheets, and a control mechanism to control the degree to which the bias mechanism counters the force of the bail on the sheet. The control mechanism may be implemented, for example, using a lost motion coupler between the bail axle and the bail and between the axle and a motor drive train, to control the torque applied to the bail axle by the bias spring. The control mechanism may be implemented, for another example, using an actuator to vary the tension in the bias spring, to control the torque applied to the bail axle by the spring.

These and other examples shown in the figures and described below illustrate but do not limit the scope of the patent, which is defined in the Claims following this Description.

As used in this document: "and/or" means one or more of the connected things; a "bail" means a hinged arm to hold or position media sheets in a tray; a "bias mechanism" means a mechanism to urge something toward a position or state; a "lost motion coupler" means a coupler in which a gap between the parts creates a range of motion through which a part may be moved without applying force or motion to another part; a "processor readable medium" means any non-transitory tangible medium that can embody, contain, store, or maintain instructions for use by a processor and may include, for example, circuits, integrated circuits, ASICs (application specific integrated circuits), hard drives, random access memory (RAM), read-only memory (ROM), and memory cards and sticks and other portable storage devices; and a "tray" means a structure to support media sheets including, for example, an input tray or an output bin.

Figure 1:
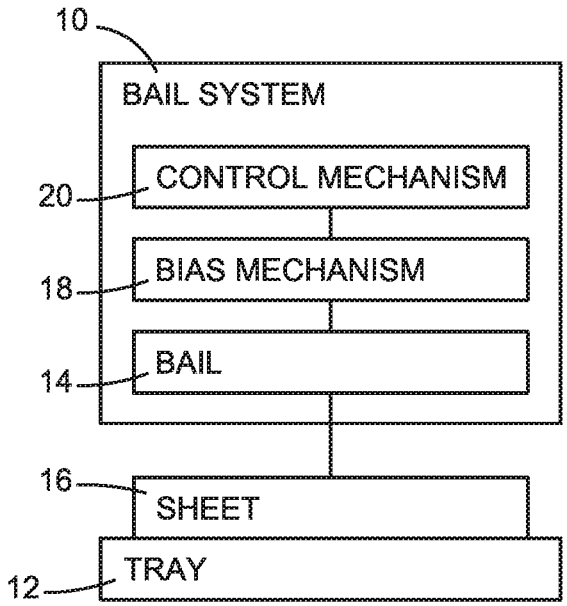
FIG. 1 is a block diagram illustrating an example bail system for a sheet media tray.

FIG. 1 is a block diagram illustrating one example of a bail system 10 for a sheet media tray 12. Referring to FIG. 1, bail system 10 includes a bail 14 to apply a force to a sheet 16 in tray 12. Tray 12 in FIG. 1 represents any suitable structure to hold or otherwise support individual media sheets or a stack of media sheets including, for example, the bins in an output device used with (or on) a printer or copier. Bail system 10 also includes a bias mechanism 18 to counter the force applied by bail 14 on a sheet 16 in tray 12 and a control mechanism 20 to control the degree to which bias mechanism 18 counters the force of bail 14 on sheet 16.

Figure 2:
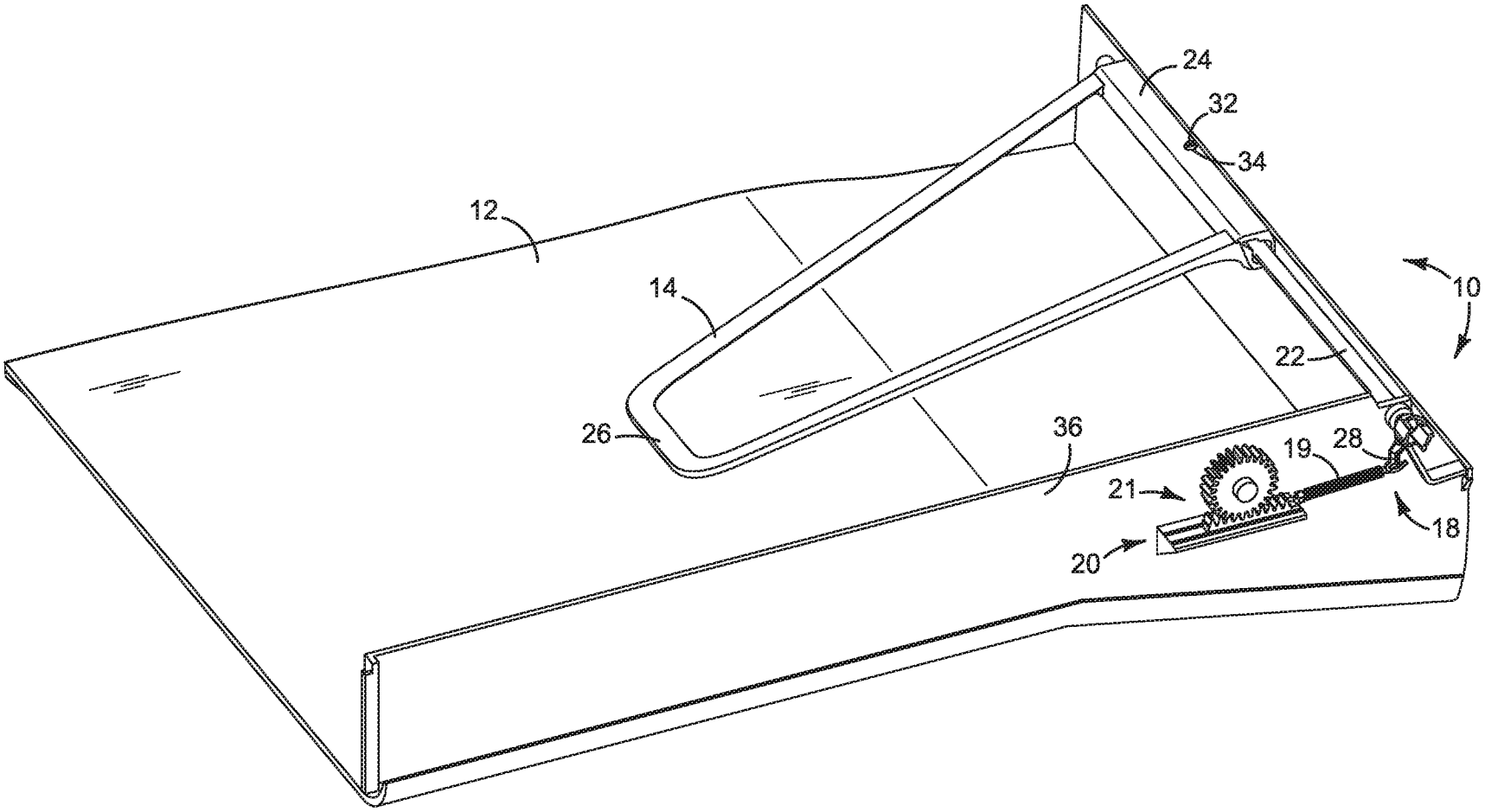
FIGS. 2 and 3 are isometric views illustrating an example for implementing a bail system such as the one shown in the block diagram of FIG. 1.
Figure 3:
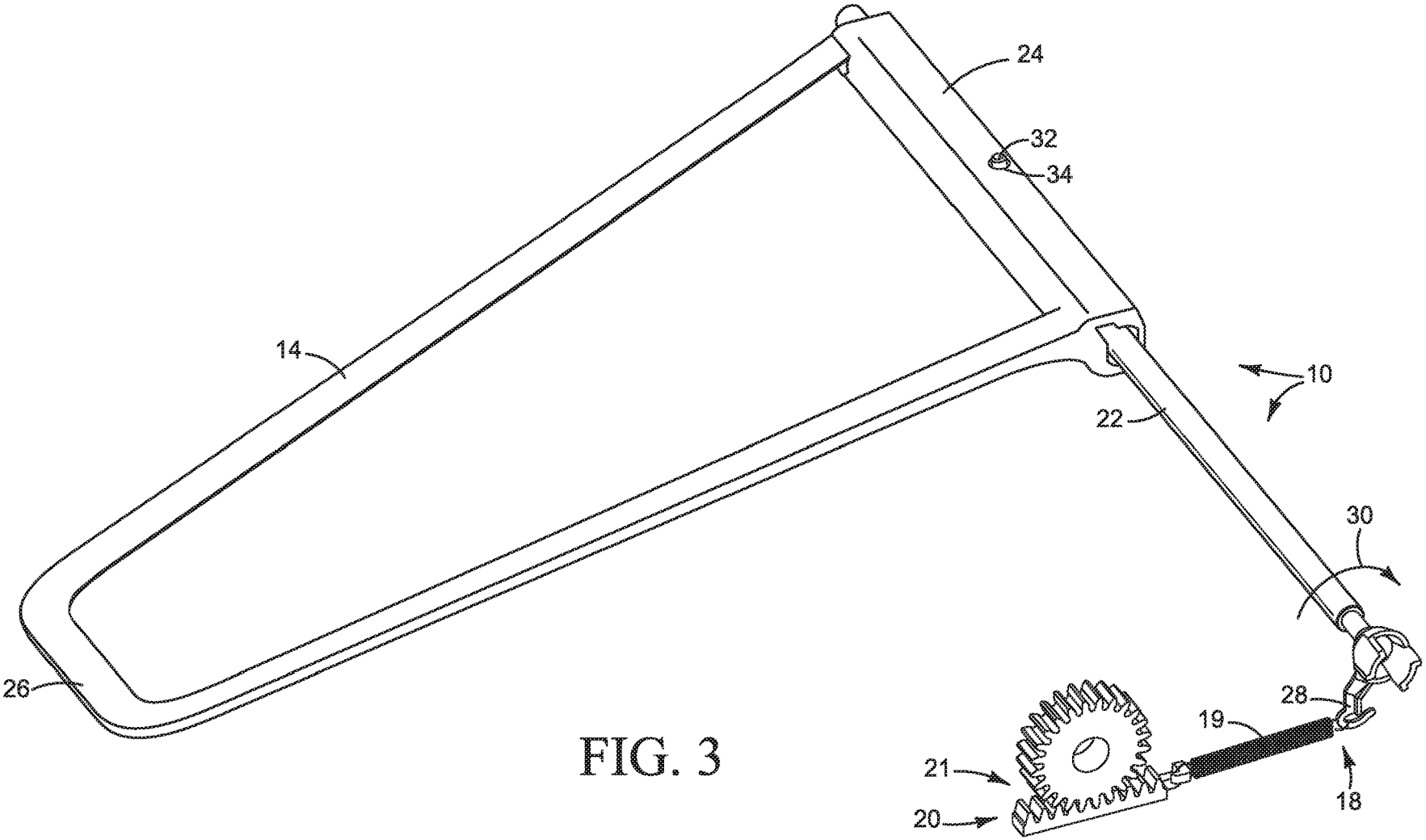

FIGS. 2 and 3 illustrate one example for implementing a bail system 10 such as the one shown in the block diagram of FIG. 1. Referring to FIGS. 2 and 3, bias mechanism 18 is implemented as a spring 19 and control mechanism 20 is implemented as an actuator 21 to adjust the tension in spring 19. Bail 14 is positioned over tray 12 to apply a bail force to a sheet or stack of sheets in tray 12. An upstream part 24 of bail 14 is supported on an axle 22 and a downstream part 26 of bail 14 extends out over tray 12. Thus, in the absence of a counter force applied by bias spring 19, downstream end 26 of bail 14 rests on tray 12 (or sheets in tray 12) and the bail force applied to a sheet moved into tray 12 corresponds directly to the weight of the bail. Other suitable bail force configurations are possible. For example, bail 14 may be spring loaded against tray 12 to increase the bail force. "Upstream" and "downstream" in this context refer to the direction sheets are moved into tray 12.

Counter force bias spring 19 is connected to axle 22 through a lever arm 28 to exert a biasing torque on the axle, as indicated by arrow 30 in FIG. 3. In this view, the direction of torque 30 is clockwise. The magnitude of torque 30 is determined by the force of spring 19 and the effective length of lever arm 28. In this example, the counter force generated by torque 30 is transmitted to bail 14 through a pin 32 on axle 14 in a hole 34 in bail 14. The pin/hole transmission shown in FIGS. 2 and 3 is just one example. Other suitable transmissions are possible.

Also in this example, bias spring 19 is configured as an extension spring connected between a chassis or other stationary part 36 and lever arm 28. A linear actuator 21 controls the length of spring 19 to adjust the counter force applied to bail 14. Actuator 21 may be operated manually, or actuator 21 may be operated automatically using a motor and programmable controller. Although a rack and pinion actuator 21 is shown, any suitable linear actuator may be used to adjust the length of an extension spring 20. Other suitable spring/actuator configurations are possible. For example, a torsion spring connected to axle 22 could be used in combination with a rotary actuator, to apply the desired counter force to bail 14.

In one example, spring 19, actuator 21, and lever arm 28 are configured together to achieve a range of counter forces between 0 and something exceeding the weight of bail 14. When actuator 21 is set to apply 0 counter force, then the bail force is unaffected by spring 19. When actuator 21 is set to apply a counter force greater than 0 but less than the weight of bail 14, then bail 14 will continue to rest on tray 12 (or sheets in tray 12) with a bail force less than the weight of bail 14. When actuator 21 is set to apply a counter force greater than the weight of bail 14, then bail 14 will be lifted off tray 12 to further reduce or eliminate the bail force applied to sheets moved into tray 12.

Figure 4:
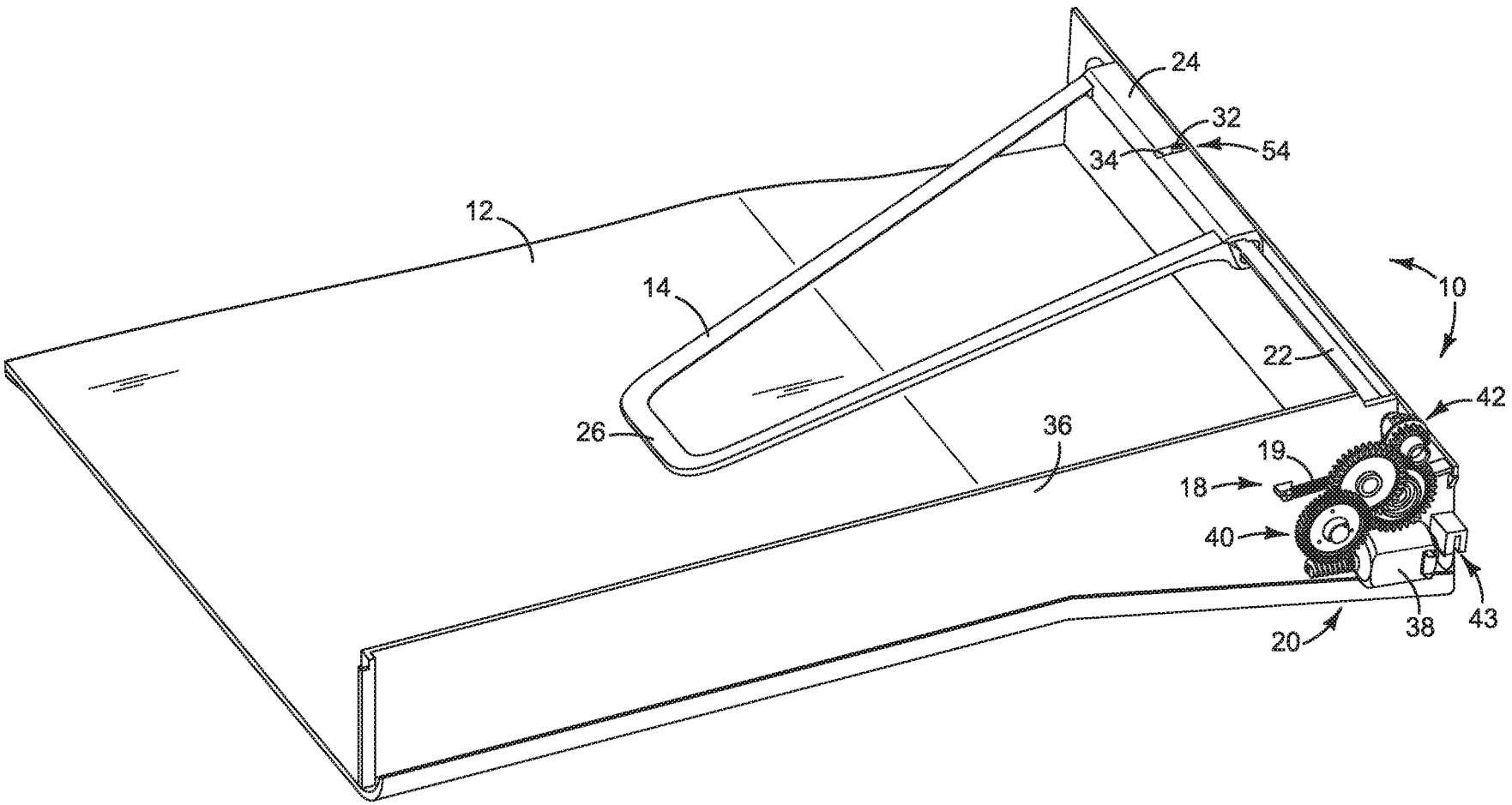
FIGS. 4-13 are isometric views illustrating another example for implementing a bail system such as the one shown in the block diagram of FIG. 1.
Figure 6:
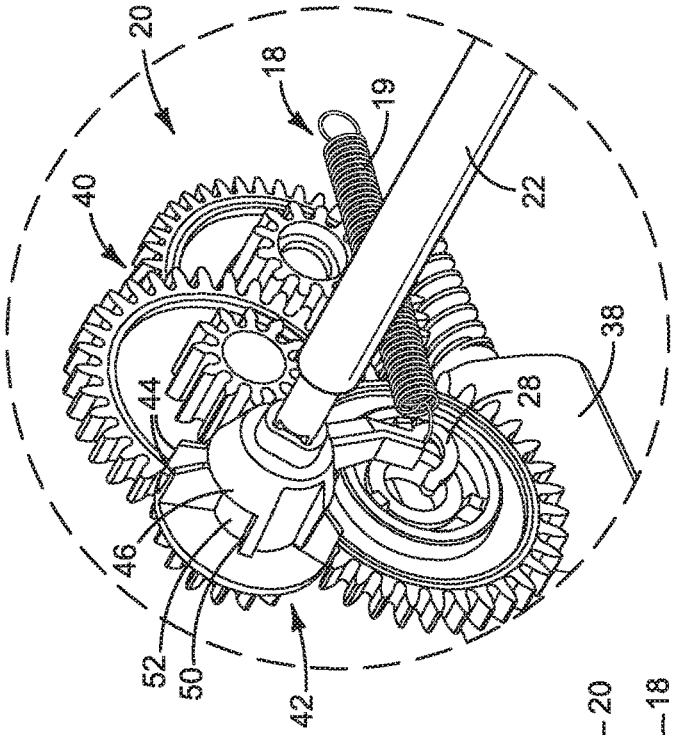
Figures 8, 9, 10:
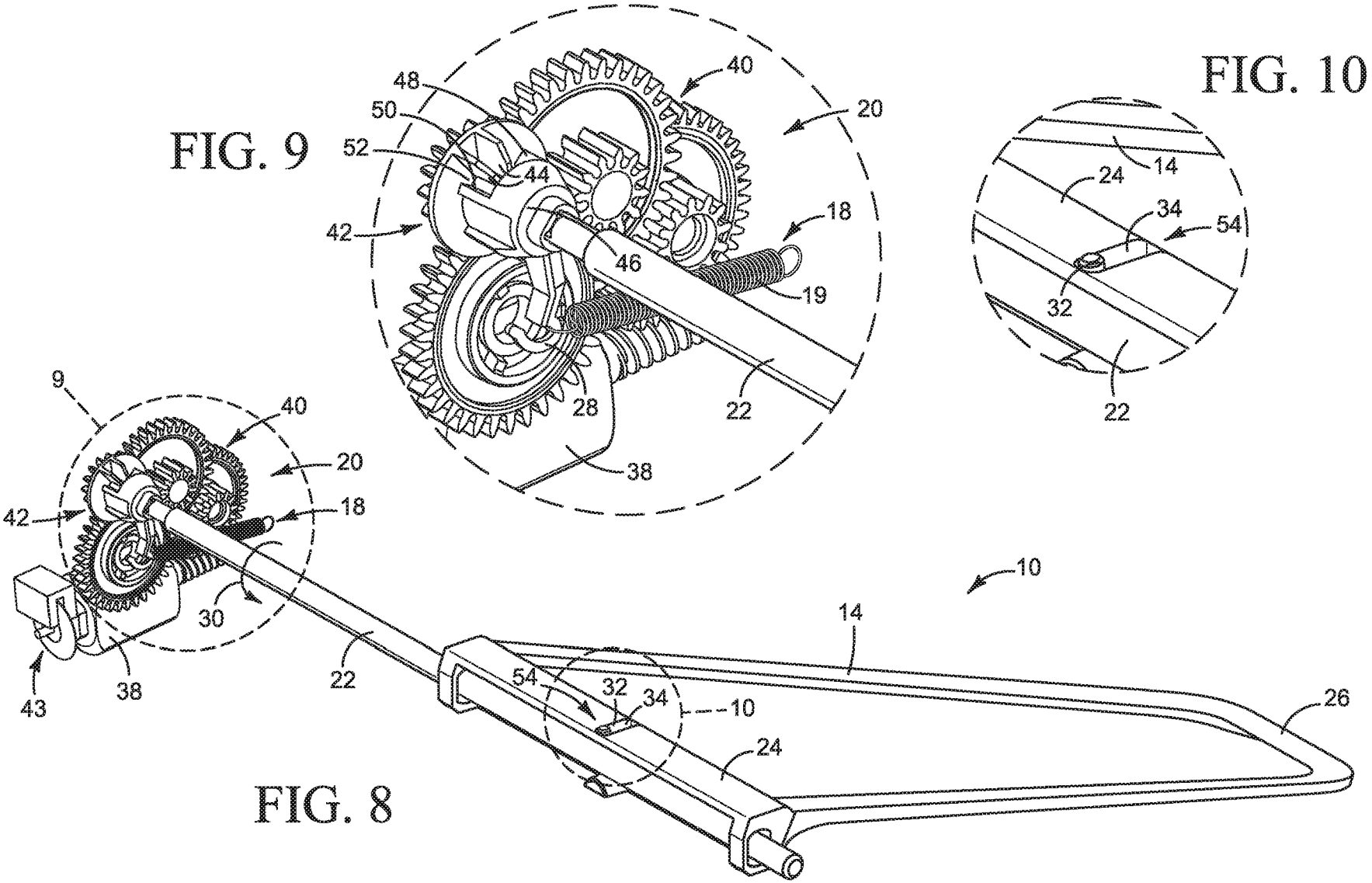
Figures 11, 12, 13:
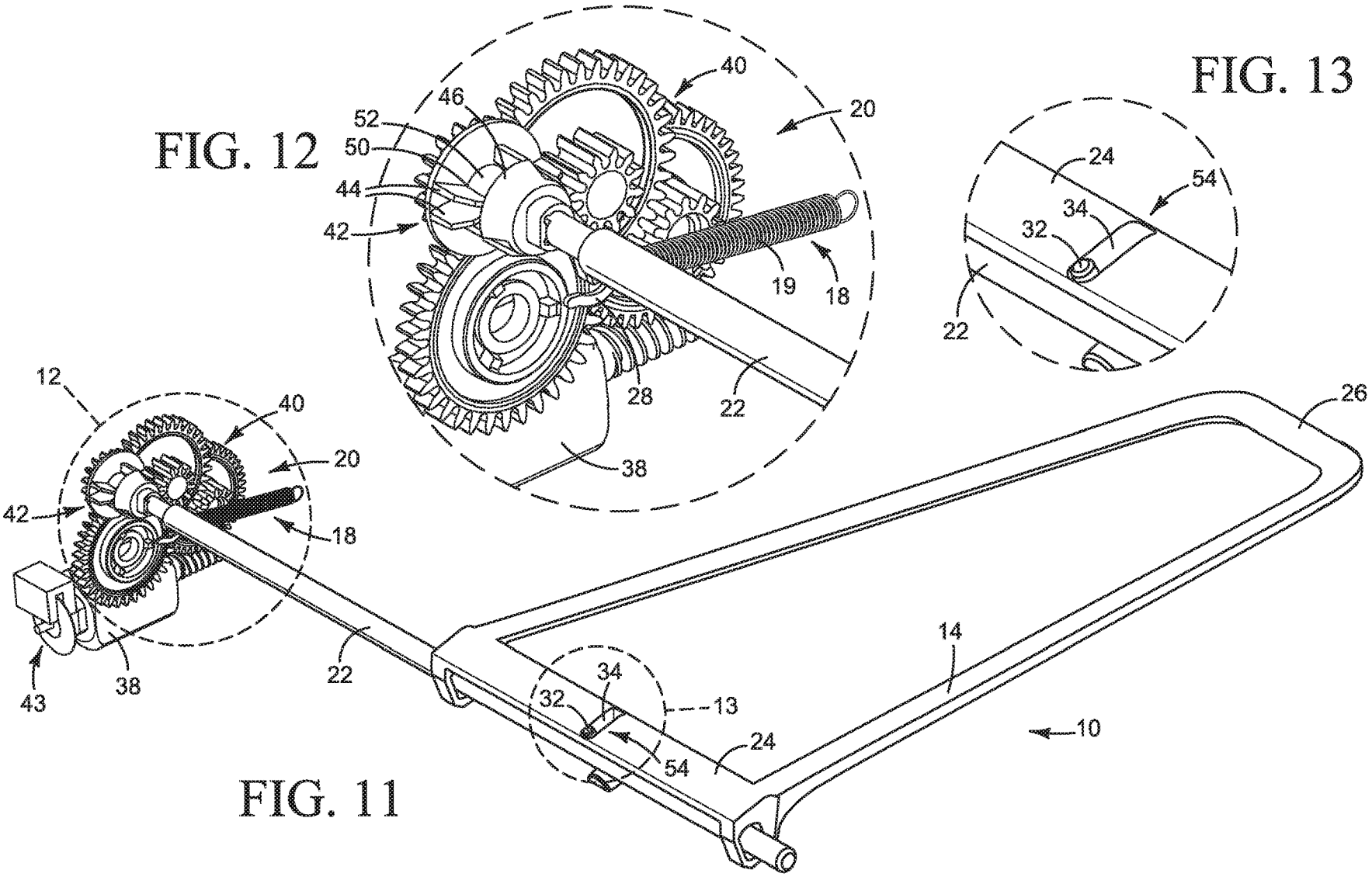

FIGS. 4-13 illustrate another example for implementing a bail system 10. FIG. 4 shows bail system 10 with a tray 12 and chassis 36. FIGS. 5-7, 8-10, and 11-13 are detail views with each set of figures showing a different position for components in the bail system. Referring to FIGS. 4-13, control mechanism 20 includes a motor 38 operatively connected to axle 22 through a drive train 40 and a first lost motion coupler 42. Control mechanism 20 may also include a position encoder 43 operatively connected to motor 38 to help accurately locate the parts. In this example, as best seen in FIGS. 6, 9, and 12, lost motion coupler 42 includes a driving finger 44 at the end of drive train 40 and a mating, driven fitting 46 at the end of axle 22. Drive finger 44 engages axle fitting 46 at each end 48, 50 of a gap 52. Gap 52 creates a range of motion through which finger 44 may be moved without applying force or motion to fitting 46 and thus axle 22. In the examples shown in the figures, drive finger 44 is configured as a V-shaped part to help mate effectively with each end 48, 50 on fitting 46 and to increase strength within the molding constraints for a plastic part 46.

Control mechanism 20 also includes a second lost motion coupler 54 to couple axle 22 to bail 14. In this example, lost motion coupler 54 includes pin 32 on axle 22 and a slot 34 in bail 14. Pin 32 can engage bail 14 at each end of slot 34. Slot 34 forms a gap that creates a range of motion through which one or both of pin 32 and bail 14 may be moved without applying force or motion to the other part, for example to allow bail 14 to be lifted as media sheets are added to tray 12.

The direction of torque 30 (FIG. 8) from bias spring 19 is counterclockwise when viewed from the perspective shown in FIGS. 5-13. Thus, when motor 38 rotates driving finger 44 away from gap end 48 counterclockwise into gap 52, then axle 22 can rotate counterclockwise at the urging of spring 19 to move axle pin 22 toward the countering (lifting) end of bail slot 24, as best seen by comparing the position of the parts in FIGS. 5-7 and 8-11. As shown in FIGS. 8-11, bias spring 19 has rotated axle pin 32 to the countering end of slot 34 to engage bail 14, and thus couple spring 19 to bail 14 to apply the desired counter force to bail 14. Correspondingly, spring 19 has rotated gap end 48 toward drive finger 44. When the counter force applied by spring 19 is greater than the bail force, so that spring lifts bail 14, then spring 19 will rotate axle 22 until gap end 48 contacts drive finger 44. Thus, the position of drive finger 44 may be used as a stop to limit the extent of lift.

Figure 7:
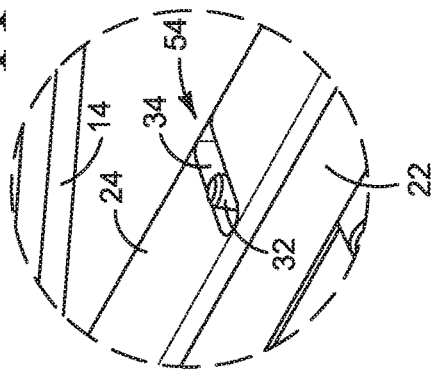
Figure 5:
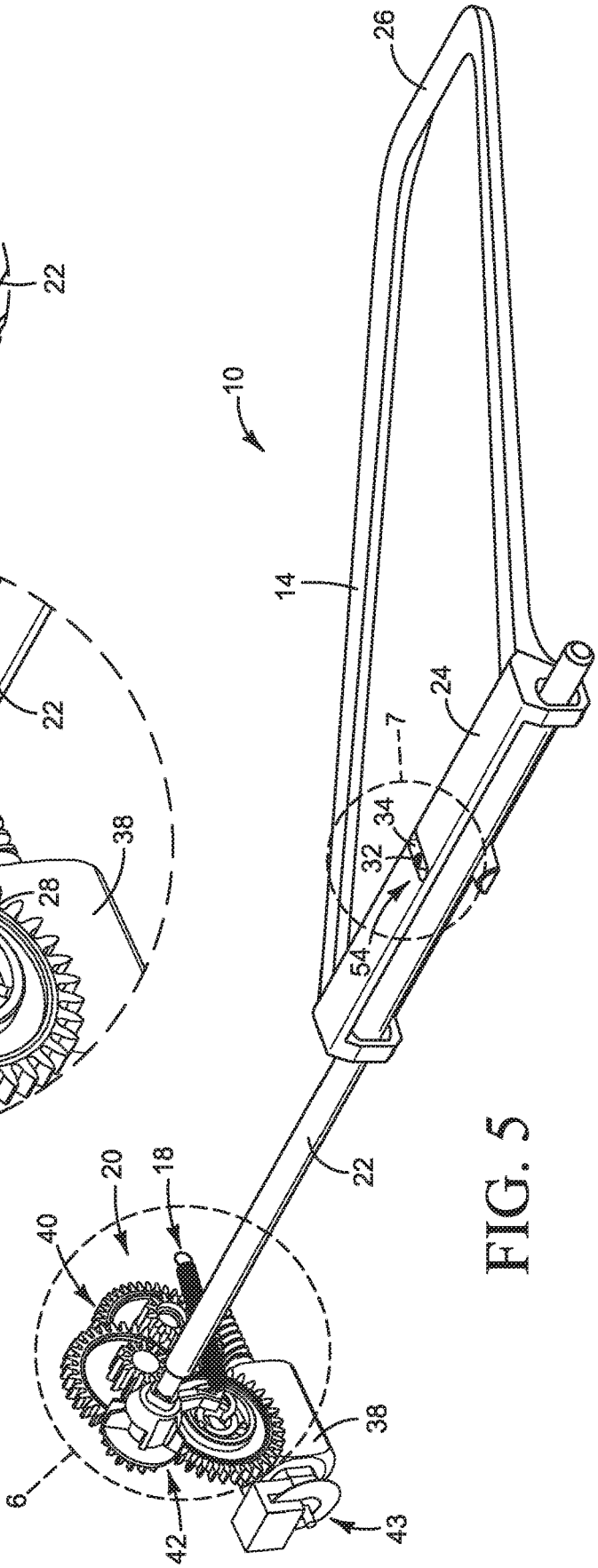

When motor 38 rotates drive finger 44 clockwise against gap end 48 to override spring 19, then axle 22 rotates clockwise to move axle pin 32 away from the countering end of bail slot 34, to decouple bail 14 from bias spring 19 (no counter force applied to bail 14), as shown in FIGS. 5-7. Motor 38 may be rotated counterclockwise against gap end 50 to lift bail 14, as shown in FIGS. 11-13. While gap 52 (with ends 48, 50) is on the axle side of coupler 42 in this example, gap 52 could be on the motor side of coupler 42.

The use of two lost motion couplers 42, 54 enables the selective application of a counter force to bail 14 while still allowing bail 14 to function free of any force from either spring 19 or motor 38. For example, without a lost motion coupler 54 to couple axle 22 to bail 14, motor 38 could not override spring 19 without also depressing bail 14, and without a lost motion coupler 42 to couple motor 38 to axle 22, motor 38 would always override spring 19 (by always applying a torque to axle 22) thus rendering spring 19 ineffective to counter the bail force.

Figure 14:
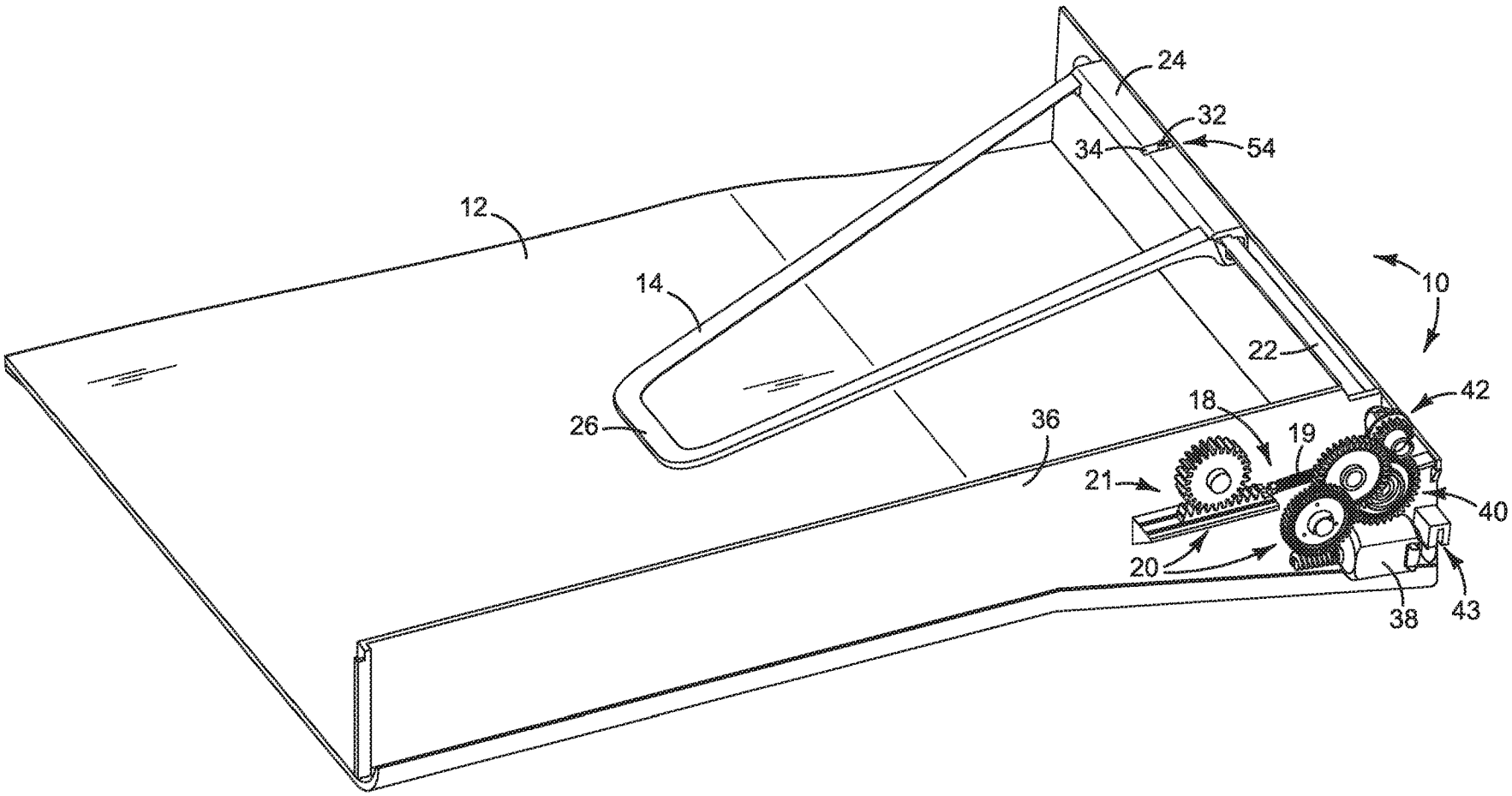
FIG. 14 is an isometric view illustrating another example for implementing a bail system such as the one shown in the block diagram of FIG. 1.

FIG. 14 illustrates another example for implementing a bail system 10. Referring to FIG. 14, control mechanism 20 includes an actuator 21 and a motor 38, drive train 40 and lost motion couplers 42, 54. Thus, in this implementation for bail system 10, the magnitude of the counter force applied to bail 14 from bias spring 19 may be adjusted with actuator 21 along a continuum, as described above with reference to FIGS. 2 and 3, and the counter force may be turned on and off with motor 38, as described above with reference to FIGS. 4-13.

Figure 15:
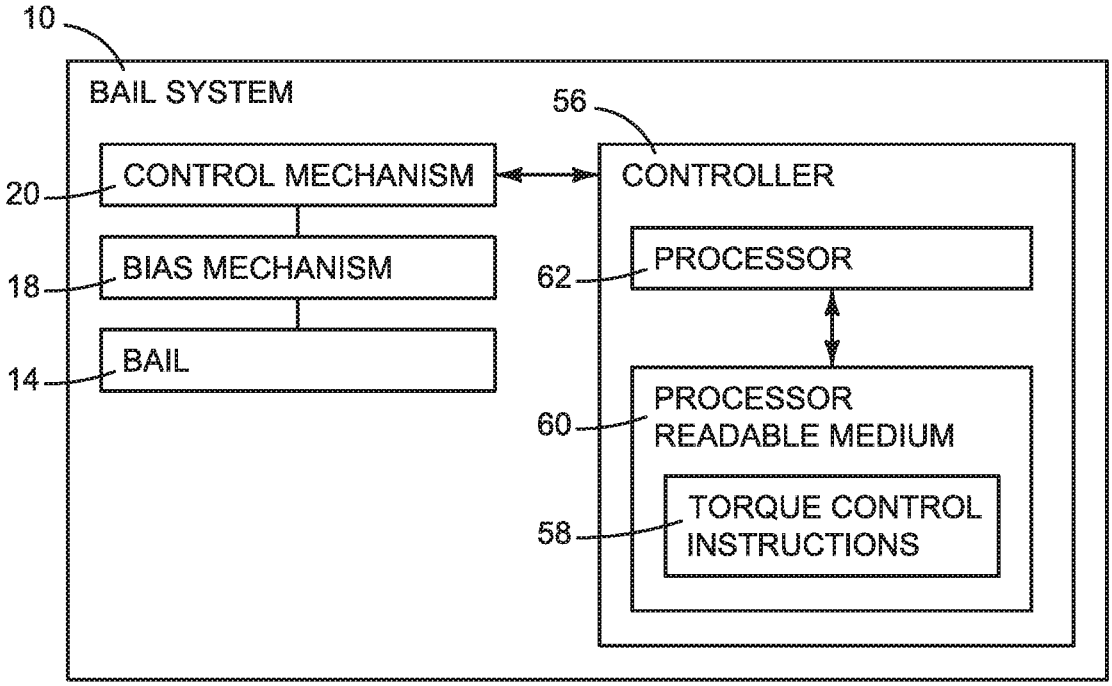
FIG. 15 is a block diagram illustrating another example of a bail system for a sheet media tray.

As shown in FIG. 15, bail system 10 may also include a controller 56 to control elements of mechanism 20. The parts referenced in the following description that do not appear in FIG. 15 are shown in FIGS. 2-14. Referring to FIG. 15, controller 56 includes torque control instructions 58 to selectively torque a bail axle 22 to vary the bail force applied to sheets in a media tray. Instructions 58 reside on a processor readable medium 60 and are executed by a processor 62 on controller 56. Controller 56 may be implemented, for example, in a controller for the printer, copier or other sheet processing machine or in a "local" controller for actuator 21 and/or motor 38 in a control mechanism 20. In one example, instructions 58 include instructions to selectively torque axle 22 to vary the bail force by varying the tension in a bias spring 19, as described above with reference to FIGS. 2 and 3. In one example, instructions 58 include instructions to selectively torque axle 22 to vary the bail force by coupling a bias mechanism 18 to bail 14 to counter the force of bail 14 and decoupling the bias mechanism 18 from bail 14 to not counter the force of bail 14, as described above with reference to FIGS. 4-13.

As noted above, the examples shown in the figures and described herein illustrate but do not limit the patent, which is defined in the following Claims.

"A", "an" and "the" used in the claims means one or more. For example, "a bias mechanism" means one or more bias mechanisms and "the bias mechanism" means the one or more bias mechanisms.

The invention claimed is:

1. A bail system for a sheet media tray, comprising:
- a bail to apply a force to a sheet in the sheet media tray;
- a spring to counter the force of the bail on the sheet; and
- a control mechanism comprising an actuator to vary a tension in the spring to control the degree to which the spring counters the force of the bail on the sheet.

2. A bail system for a sheet media tray, comprising:
- a bail to apply a force to a sheet in the sheet media tray;
- a bias mechanism to counter the force of the bail on the sheet; and
- a control mechanism to control the degree to which the bias mechanism counters the force of the bail on the sheet, the control mechanism comprising:
  - a coupler to couple the bias mechanism to the bail to counter the force of the bail on the sheet and to decouple the bias mechanism from the bail to not counter the force of the bail on the sheet, to control the degree to which the bias mechanism counters the force of the bail on the sheet; and
  - a drive mechanism that includes an axle, a motor and a drive train to rotate the axle at the urging of the motor, the coupler operatively connected to the axle to couple the bias mechanism to the bail when the axle is in a first rotational position and to decouple the bias mechanism from the bail when the axle is in a second rotational position different from the first position.

3. The system of claim 2, where the coupler is operatively connected between the axle and the drive train and/or between the axle and the bail.

4. The system of claim 3, where the coupler comprises:

a first lost motion coupler connected between the axle and the drive train; and a second lost motion coupler connected between the axle and the bail.

5. The system of claim 4, where:

the first lost motion coupler comprises a finger at the end of the drive train and a fitting at the end of axle, the fitting having a gap therein and the finger movable in the gap between a first position when the axle is in a first rotational position in which the motor does not override the bias mechanism, to couple the bias mechanism to the axle, and a closed position when the axle is in a second rotational position in which the motor overrides the bias mechanism, to decouple the bias mechanism from the axle; and the second lost motion coupler comprises a pin on the axle and a slot in the bail, the pin movable in the slot between a first position when the axle is in a first rotational position in which the pin engages the bail, to couple the axle to the bail, and a disengaged position when the axle is in a second rotational position in which the pin does not engage the bail, to decouple the axle from the bail.

6. A bail system for a sheet media tray, comprising:

a bail to apply a bail force to a sheet in the sheet media tray;

an axle supporting the bail;

a spring operatively connected to the axle to torque the axle in a first direction;

a slot in the bail; and a pin on the axle in the slot, the axle rotatable in the first direction at the urging of the spring to move the pin to an engaged position in which the pin engages the bail at one end of the slot to counter the bail force with a spring force.

7. The system of claim 6, where the spring force is less than the bail force.

8. The system of claim 6, comprising a motor operatively connected to the axle to torque the axle in a second direction opposite the first direction to override the spring force.

9. The system of claim 8, where the motor is connected to the axle through a drive train that includes a lost motion coupler movable between a first position in which the motor does not override the spring force and a second position in which the motor overrides the spring force.

10. The system of claim 6, comprising an actuator to vary the spring force.

11. A non-transitory processor readable medium having instructions thereon to selectively torque a bail axle to vary a bail force applied to sheets in a media tray, including instructions to vary the tension in a bias spring, couple the bias spring to the bail to counter a force of the bail, and decouple the bias spring from the bail to not counter the force of the bail.

12. A controller implementing the processor readable medium of claim 11.

* * * * *